United States Patent [19]

Moscony et al.

[11] 4,025,661

[45] May 24, 1977

[54] METHOD OF MAKING VIEWING-SCREEN STRUCTURE FOR A CATHODE-RAY TUBE

[75] Inventors: John Joseph Moscony, Lancaster; Joseph John Piascinski, Leola, both of Pa.

[73] Assignee: RCA Corporation, New York, N.Y.

[22] Filed: Nov. 13, 1972

[21] Appl. No.: 305,695

[52] U.S. Cl. ..... 427/68; 427/73

[51] Int. Cl.[2] ..... H01J 29/07

[58] Field of Search ..... 117/33.5 CP, 33.5 CM, 117/33.5 C, 35 R, 71 R, 45, 16, 216, 38, 47 A; 313/92 P, 92 R, 92 CS; 427/68, 73

[56] References Cited

UNITED STATES PATENTS

| | | | |
|---|---|---|---|
| 2,597,617 | 5/1952 | Campbell | 117/335 P |
| 2,951,773 | 9/1960 | Helle et al. | 117/211 |
| 3,392,297 | 7/1968 | Schwartz | 313/92 R |
| 3,475,639 | 10/1969 | Driffort et al. | 313/92 R |
| 3,703,401 | 11/1972 | Deal et al. | 117/33.5 CP |

*Primary Examiner*—James R. Hoffman
*Attorney, Agent, or Firm*—G. H. Bruestle; L. Greenspan

[57] ABSTRACT

An aluminized luminescent viewing-screen structure for a cathode-ray tube includes a carbon particle layer in contact with the aluminum layer. The carbon-particle layer is substantially free from metal-ion-containing materials, particularly compounds of alkali and alkaline earth metals.

A viewing-screen structure comprising a light-reflective aluminum metal layer having a carbon-particle layer thereon may be made by: (a) depositing on the metal layer a coating of organic, volatilizable, film-forming material, (b) depositing on the coated metal layer an over-coating of carbon particles that is substantially free from substances which, when incinerated, produce metal-ion-containing residues and (c) then baking the screen and support in air at about 400° to 450° C to remove organic and volatile matter.

1 Claim, No Drawings

METHOD OF MAKING VIEWING-SCREEN STRUCTURE FOR A CATHODE-RAY TUBE

BACKGROUND OF THE INVENTION

This invention relates to a novel viewing-screen structure for a cathode-ray tube and to a novel method for preparing that viewing-screen structure.

One type of cathode-ray tube that is used for television displays is referred to as a shadow-mask tube. This tube is comprised of an evacuated envelope having a viewing window, a viewing-screen structure comprised of a mosaic of phosphor areas (usually dots or strips) of different emission colors supported on the inner surface of the viewing window, a shadow mask having an array of apertures therein in register with the phosphor areas mounted in the tube in adjacent spaced relation with the window, and means for projecting one or more (usually three) electron beams towards the screen for selectively exciting the phosphor areas of the mosaic.

In operating a shadow-mask tube, the electron beams are made to scan a raster in a fixed pattern. As the beams are made to scan, they are either intercepted by the mask or they pass through the mask apertures and excite the desired phosphor areas. The energy in the intercepted electron beams heats the mask and may cause the mask to become distorted, which may adversely affect the position of the beams which pass through the mask apertures. Some of the heat in the mask is removed by radiation back to a black coating on the funnel of the tube. Normally, the viewing-screen structure includes a thin layer of a highly reflective metal, usually aluminum, which reflects heat that is radiated forward towards the screen.

U.S. Pat. No. 3,703,401, issued Nov. 21, 1972, to Samuel B. Deal and Donald W. Bartch, suggests applying to the reflective metal layer a heat-absorptive overcoating of carbon particles. Then, the structure is baked to remove organic and volatile materials therefrom. The purpose of a heat-absorptive overcoating is to promote the transport of heat from the shadow mask to the atmosphere through the glass panel and thereby reduce mask warpage due to uneven heating of the mask-frame assembly of the tube. Common formulations used in applying these overcoatings include such constituents as finely-divided particles of graphite and lamp black together with dispersants and wetting agents.

Overcoatings produced with the common formulations have been found to be prone to the formation of defects on the viewing screen and on the sidewalls of the screen support during tube fabrication, particularly when exposed to normal humid atmosphere for any extended period of time after the screen is baked. Some of the defects appear as a complete loss of reflectivity in small areas more or less scattered over the reflective layer and sidewalls. The size and frequency of the defects increase with increasing humidity and also with temperature. This humidity or moisture susceptibility of a baked screen structure is a serious problem which may result in costly losses to normal factory processing.

SUMMARY OF THE INVENTION

The novel aluminized screen structure includes a carbon-particle layer in contact with the aluminum metal layer as in the prior art. We have discovered that, when the carbon-particle layer is substantially free from metal-ion-containing residues, particularly alkali-metal-ion-containing residues, the screen structure is not prone to the formation of the above-described defects. Substances which form metal-ion-containing residues when incinerated are normally present in the formulations used for applying the carbon particle layer. It is believed that, after baking the screen structure at about 450° C, large amounts of moisture are adsorbed from the atmosphere by the carbon particles present in the carbon particle layer. The ordinarily present metal-ion-containing residues of the baking step, in the presence of moisture, react directly or indirectly with the aluminum metal of the reflective layer to form aluminum compounds which have markedly lower reflectivity than aluminum metal.

The novel method includes (a) depositing on the reflective metal layer of the screen structure a coating of organic, volatilizable, film-forming material, (b) depositing upon the coated metal layer an overcoating of carbon particles, said overcoating being substantially free from substances which, when incinerated, produce metal-ion-containing residues (c) and then baking the screen structure in air at about 400° to 450° C to remove organic and volatile matter. By providing that the overcoating is substantially free of such substances, a necessary factor toward producing defects by interaction with moisture and humidity is absent. Thereby, the product of the process exhibits a markedly increased resistance to humidity-induced defects on the screen structure.

DETAILED DESCRIPTION OF THE PREFERRED EMBODIMENT

The preferred embodiment of the novel method is applied to the manufacture of a color-television picture tube of the type described in U.S. Pat. No. 3,423,621 to Martin R. Royce. The preferred embodiment of the novel method starts with a faceplate panel which is subsequent to the aluminizing of the viewing screen. The panel has a phosphor mosaic viewing screen deposited on the inner surface thereof, a volatilizable film deposited thereon and a light-reflective layer of aluminum metal about 2500 Angstroms thick deposited on the film. Processes for preparing this intermediate structure are known, as exemplified by U.S. Pat. Nos. 3,067,055, 3,582,389 and 3,582,390 to Theodore A. Saulnier, Jr. and include depositing a viewing screen upon the inner surface of the viewing window or other support, depositing a volatilizable film upon the viewing screen, and depositing a reflective metal layer upon the film. Since these processes are described in detail elsewhere, they need not be redescribed here.

EXAMPLE

An example for practicing the novel method by hand is now described. The panel and intermediate structure thereon are placed in an oven that is preheated to about 85° to 95° C and kept there for about 7 minutes until the panel is at about the oven temperature. The panel is removed from the oven, and the panel seal lands and the inner sidewalls of the panel including the mask-mounting studs are masked as with a shield to about the mold match line, but leaving the entire viewing area unmasked. Then, with the panel still preheated, an aqueous dispersion of a volatilizable film-forming material is sprayed upon the unmasked aluminum metal layer. A preferred dispersion that is substantially free from substances which, when incinerated, yield metal-ion-containing residues is prepared by mixing 250 milliliters of an aqueous acrylic resin emulsion (containing about 46 weight percent solids) and 14 grams PVP with 2050 milliliters deionized water. A preferred acrylic resin emulsion is Rhoplex AC-33 marketed by Rohm and Haas Company, Philadelphia, Pa., which is believed to be constituted principally of ethyl acrylate copolymerized with minor amounts of acrylic and methacrylic monomers and polymers. The spraying is conducted for about 2 to 5 minutes with an air spray gun operating at about 20-pounds-per-square-inch pressure, and includes about ten passes of the spray across the surface. The sprayed material dries in less than a minute, due in part to the heat in the preheated panel, forming a sealer coating or barrier layer.

Then, with the panel still preheated, and the shield in place, a binder-free aqueous suspension of graphite and carbon black that is substantially free from substances which, when incinerated, yield metal-ion-containing residues is sprayed upon the unmasked portions of the coated metal layer. A preferred suspension is prepared by mixing about 1000 milliliters of a 5-weight-percent aqueous dispersion of colloidal graphite with about 1876 milliliters deionized water and about 1000 milliliters of a 5-weight-percent aqueous dispersion of carbon black, such as Vulcan XC-72R carbon black marketed by Cabot Corporation, Boston, Mass., and containing about 1.2 weight percent alkali-free dispersing agent such as polyvinylpyrrolidone (PVP). The spraying is conducted for about 2 to 5 minutes with an air spray gun operating at about 20 pounds-per-square-inch pressure and includes about twenty passes of the spray across the surface to provide a coating weight of about 0.15 mg/cm$^2$. The sprayed material dries in less than a minute due in part to the heat in the preheated panel, and forms a heat-absorptive overcoating.

The shield is removed, and the coated panel is now processed in the usual way. This includes the usual step of baking the panel in air at about 400° to 450° C to remove, by vaporization and oxidation, the volatile and organic matter in the structure. In this last baking step, the film and coating of volatilizable material underlying and overlying the aluminum metal layer, the binders in the mosaic viewing screen, and all of the dispersing agents and wetting agents in the structure are removed. After baking, the structure is substantially free from metal-ion-containing residue. The structure includes an aluminum metal reflective layer on the phosphor mosaic viewing screen and a heat-absorbent carbon-and-graphite overcoating adhered upon the aluminum layer.

GENERAL CONSIDERATIONS

In this document, the term "metal-ion-containing residues" is used to define a class of substances (including oxides, hydroxides and salts) which dissolve or react with water, such that the most electropositive element in the substance appears as a cation in solution. The term is broader than "alkali-metal-ion residues," which are compounds of the alkali metals. Metal-ion-containing residues include iron, manganese and titanium compounds, for example. The most prevalent and troublesome residues include compounds of the alkali metals, particularly sodium and potassium; and of the alkaline earth metals.

An important reason for screen and sidewall defects is related to the presence of metal-ion-containing residues in the formulations used to fabricate the screen structure. Metal-ion-containing residues are formed by substances normally present in the coating and overcoating. After baking at about 400° to 450° C, the presence of these residues linked with the high moisture adsorptive capacity of carbon and graphite particles provides a mechanism for forming defects by degrading the light-reflective ability of the reflective metal layer. One mechanism is believed to be as follows:

1. Moisture from the humidity in the ambient is adsorbed by the graphite and carbon particles.

2. The adsorbed water reacts with metal-ion-containing residues, such as alkali and alkaline earth residues, that are present to form reactants, such as sodium hydroxide $$Na_2O + H_2O \rightarrow 2NaOH.$$

3. The reactants react with aluminum to form aluminum compounds with markedly lower reflectivity, such as by the reaction:

$$2Al + 2NaOH + 6H_2O \rightleftarrows 2Al(OH)_4^- + 2Na^+ + 3H_2.$$

This reaction can cause screen and sidewall defects by converting aluminum metal to aluminum salt.

4. The substances present can react also with the phosphor in the viewing screen to form nonluminescent substances, such as by the reaction:

$$ZnS{:}M + 2H_2O + 2NaOH \rightleftarrows Zn(OH)_4^{-2} + Na_2S + 2H^+ + M^+.$$

This reaction can cause screen defects by converting the phosphor to a nonluminescent material.

The damage to the reflective metal layer can be reduced to a minimum by using coatings and overcoatings which, after baking, do not produce metal-ion-containing residues. For example, the substitution for the dispersant "Marasperse" (which yields a 70% alkali residue after baking at 450° C for about 4 hours in air) of polyvinylpyrrolidone (which yields less than 0.001% residue after baking at 450° C for about 4 hours) has the effect of at least doubling the time before the appearance of defects at 52% relative humidity (RH). If the proprietary substance "Aquadag," which contains graphite and also has some alkali-ion-containing residues after baking at 450° C, is replaced with "pure" graphite, no defects are observed after 72 hours at 52% RH. When Aquadag is present with dispersants such as "Marasperse," defects are observed within 4 to 6 hours. At 72% RH, there is a very dramatic improvement in the resistance to the formation of moisture defects with alkali-free overcoatings. Overcoatings with alkali residues show defects after 2 hours at 72% RH. Without alkali residues, no defects are observed after 24 hours at 72% RH. Thus, the novel method employs an overcoating and preferably also a coating that contains a minimum of substances which when incinerated form residues that can react to destroy the efficiency and/or the appearance of the screen structure of the tube.

There are many variations that may be made to the preferred embodiment that fall within the scope of the novel method. The carbon overcoating is applied to the reflective metal layer after the metal layer is deposited but before the structure is baked to remove the organic film used to impart a shiny surface to the metal layer. The structure has a substantial number of pores to permit the escape of gases during subsequent baking steps.

Either graphite or amorphous carbon, or a combination of the two, may be used for the carbon overcoating. Amorphous carbon may be in the form of lamp black, carbon black or other forms prepared from the incomplete burning of carbon-bearing materials. It is believed that sub-micronsize carbon particles in the overcoating act more effectively to absorb water than particles of "pure" graphite, which are generally in the size range of 1 to 10 microns. It has been observed that graphite particles are more resistant to oxidation and tend less to penetrate the viewing screen than the amorphous carbon particles. Amorphous carbon particles produce layers that are more heat absorbent and are less resistant to electron penetration. The submicron average size of the amorphous carbon particles is believed to act more effectively to absorb water than the graphite particles which are generally in the 1 to 10 micron size range.

The particle size of the carbon particles is preferably colloidal in size to facilitate the preparation and maintenance of a suitable suspension. The carbon may be suspended in any liquid vehicle such as toluene or xylene. However, it is preferred to disperse the carbon in water. When carbon particles are dispersed in water, it has been found desirable to include wetting and dispersing agents for the purpose of producing a stable suspension. Also, it has been found desirable to omit binders for the particles from the suspension. When binders have been included, it has been found that the carbon particles may oxidize excessively during the subsequent baking step, thereby making the process control more difficult.

Some suitable dispersants and binders which have very low contents of metal-ion-containing residues, particularly alkali-metal-ion-containing residues, include polyvinylpyrrolidone (PVP), polyvinyl alcohol, ethylcellulose, carboxyl methyl cellulose and proprietary agents such as Triton CF-18 (Rohm and Haas), Brij 35 (Atlas) and Pluronic L-72 (Wyandotte).

The sealer coating or barrier layer may be of any volatilizable film-forming material which will perform the function of preventing carbon particles from entering the pores in the aluminum metal layer and passing to the phosphor mosaic or viewing screen. Some suitable materials for this purpose are acrylic copolymers such as Rhoplex AC-33, B74, B83, B83, C72 and D70, all marketed by Rohm and Haas Company, Philadelphia, Pa. Another suitable material is a polystyrene emulsion such as 40-201 Synthemul marketed by Reichhold Chemicals Inc., White Plains, N.Y. The use of a barrier layer or sealer coating provides a means for preventing the carbon from penetrating through the aluminum metal layer into the phosphor mosaic when the carbon suspension is applied. Such penetration could result in staining, smudginess, and reduced visual brightness of the phosphor screen.

Preheating the panel and intermediate structure assists in drying the coatings that are subsequently applied thereto. The omission of preheating results in running of the coatings. Solvent-based carbon formulations have been made which do not need the preheating step. However, water-based systems of both the carbon formulation and the sealer formulation require the preheating step. The water-based systems are preferable because of the better safety aspects and because of reduced equipment costs. Preheating temperatures are in the range of about 85° to 105° C and preferably about 90° C.

The sealer coating and the carbon overcoating may be applied by any convenient process. The preferred process is by air spraying because of its low cost and great convenience. The sealer coating is applied as the thinnest layer which will provide the function of blocking carbon particles from penetrating into the phosphor mosaic. The carbon overcoating is applied in a thickness of about 2700 to 3700 Angstroms. This should be controlled because the thickness affects the penetration of the electron beam which eventually can excite the phosphor mosaic. Excessively thick carbon layers should be avoided since they reduce the brightness of the screen. The aluminum metal layer is preferably about 2,000 to 3,000 Angstroms thick so that the combination of aluminum metal layer and carbon layer is between 4,700 and 6,700 Angstroms thick. Ordinarily the aluminum metal layer itself is about 5,000 to 6,000 Angstroms thick.

At higher humidities (70 to 100%), slight moisture defects sometimes occur after extended periods (24 hours), even when substances which produce metal-ion-containing residues are eliminated from the formulation. The defects occur on the sidewalls of the cap. We have found that excellent resistance to high humidity defects can be obtained by spraying a protective, stable, inert coating on the sidewall aluminum before the application of the sealer coating and heat-absorptive overcoating. The protective sidewall coating is not applied to the screen because it is not needed. The increased sensitivity of the sidewall to the formation of moisture defects is probably related to the aluminum/-glass interface of the sidewalls as distinct from the aluminum-phosphor interface of the screen.

The protective coating applied to the aluminum on the sidewalls is preferably chemically and thermally stable. A material such as a fumed silicon dioxide marketed by Cabot Corporation under the trade name of Silanox 101 has been found to prevent the appearance of moisture defects at high humidity.

One procedure for spray application of a protective sidewall coating is as follows:

1. Preheat a screened, aluminized cap to about 90° C for about ½ hour.

2. A solution of up to 2.5% Silanox 101 in isopropyl alcohol using 1% polyvinylpyrrolidone as a binder is prepared. The Silanox 101 solution is sprayed on the aluminized sidewall and blend radius only.

3. A sealer coating is applied to the screen followed by a heat-absorptive overcoating as described above.

The features described in this invention can be applied to a light-absorbing matrix used in a matrix tube, wherein similar moisture sensitivity problems are encountered. Also, using graphite suspensions that are substantially free of substances which, when incinerated at about 450° C, form metal-ion-containing residues for preparing internal conductive coatings appears worthwhile due to the absence of undesirable side reactions, e.g., $$1.\ Na_2O + H_2O \rightarrow 2NaOH \text{ (b. p. NaOH + 1390° C)}$$

Then after exhaust and getter flash, $$2.\ H_2O + 2NaOH + Ba \rightarrow Ba(OH)_2 + Na_2O + H_2$$

The resultant effect is unnecessary getter consumption and the release of undesirable gas within the tube.

The novel method may be applied to shadow-mask tubes for the purpose of providing a heat-absorbing layer on the aluminum reflective layer of the screen structure. The method may be applied to other cathode-ray tube types for the purpose of depositing carbon in any of its forms to the aluminum metal layer. For example, the method may be applied to providing a carbon layer upon a metal reflective layer to reduce secondary emission and electron scattering. The use of a carbon layer for reducing secondary emission and scattering is described in U.S. Pat. No. 2,878,411 to L. W. Alvarez and in U.S. Pat. No. 3,475,639 to J. P. Driffort et al.

We claim:

1. In a method for making a viewing-screen structure for a cathode-ray tube having a viewing-screen support, a viewing screen thereon, and a light-reflective metal layer on said screen, the steps subsequent to producing said metal layer comprising:

a. depositing upon said metal layer a coating of an organic volatilizable film-forming material, b. depositing upon the coated metal layer an overcoating of carbon particles, said overcoating being deposited from a suspension consisting essentially of carbon particles, dispersant therefore and a liquid, c. and then baking said screen in air at about 400° to 450° C to remove organic and volatile matter, the improvement wherein said organic volatilizable film-forming material and said suspension are free from substances which, when incinerated, produce residues containing alkali metal, alkaline earth metal, iron, manganese or titanium ions.

* * * * *